United States Patent [19]

Mourou

[11] 4,301,362

[45] Nov. 17, 1981

[54] LIGHT ACTIVATED SOLID STATE SWITCH

[75] Inventor: Gerard Mourou, Rochester, N.Y.

[73] Assignee: University of Rochester, Rochester, N.Y.

[21] Appl. No.: 96,711

[22] Filed: Nov. 21, 1979

[51] Int. Cl.[3] ..... H01J 40/14

[52] U.S. Cl. ..... 250/211 J

[58] Field of Search ..... 250/352, 370, 211 R, 250/211 J; 357/29, 30

[56] References Cited

U.S. PATENT DOCUMENTS 3,917,943 11/1975 Auston ..... 250/211 J 4,116,063 9/1978 LeBlanc et al. ..... 250/352

4,218,618 8/1980 Mourou ..... 250/211 J

*Primary Examiner*—David C. Nelms

*Attorney, Agent, or Firm*—Martin LuKacher

[57] ABSTRACT

A semiconductor body, having deep lying charge carrier trapping centers, as by being doped with a deep-lying impurity to a concentration such that, at cryogenic temperature, the body is capable of holding off a multi-kilovolt DC bias without thermal instability and of switching the bias with picosecond accuracy to generate pulses of selected durations beyond the subnanosecond range when activated by optical pulses, as from a laser, which are incident thereon.

21 Claims, 1 Drawing Figure

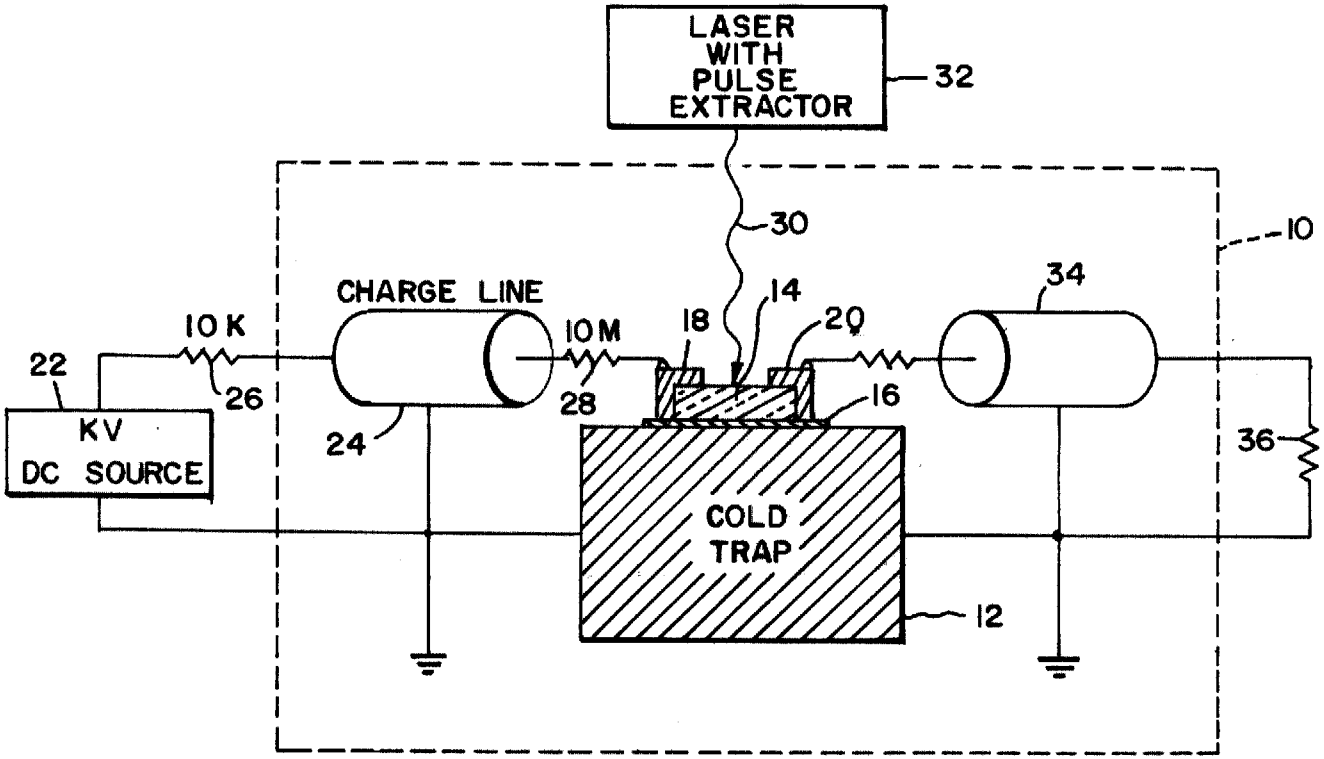
LASER WITH PULSE EXTRACTOR
32
30
10
34
36
20
14
16
18
12
COLD TRAP
10 M
28
CHARGE LINE
24
10 K
26
KV DC SOURCE
22

LIGHT ACTIVATED SOLID STATE SWITCH

The present invention relates to light activated solid state switches and particularly to a light activated solid state switch for switching multi-kilovolt DC voltages to generate high voltage pulses within picoseconds of activation by a optical pulse.

The invention is especially suitable for use in generating multi-kilovolt pulses with precision timing accuracy and amplitude stability for driving electro optic devices such as Kerr and Pockels cells, streak cameras, framing cameras and shutter or gating tubes.

This invention is related to the invention described in U.S. Patent application Ser. No. 13,642 filed Feb. 21, 1979, U.S. Pat. No. 4,218,618 by Gerard Mourou for *Apparatus For Switching High Voltage Pulses With Picosecond Accuracy.*

Light activated solid state switches have been proposed by Auston in U.S. Pat. No. 3,917,943. Such swtiches are subject to thermal instability when subjected to high DC voltages greater than a few hundred volts across the device. The devices were first used with very short pulses in the nanosecond regime (see Antonetti, Malley, Mourou and Orszag, *Optics Communications,* 23, 3, 435 (1977) and LeFur & Auston, *Appl. Phys. Lett.,* 28, 21 (1976)). The invention of the above referenced patent application provides improvements which enable a multikilovolt pulses of longer duration in the microsecond and millisecond regime to be applied to the devices before thermal instability sets in, thereby relaxing the stringent timing requirements of the techniques suggested in the *Optics Communications* article, referenced above. Pulsed biases however are subject to amplitude fluctuations which may effect the timing accuracy of the switching. Variations in bias amplitude may cause in some applications some jitter (± a few picoseconds variation of the output pulse). The system is also complicated by the need for circuitry for synchronization of the biasing pulse and the laser which produces the optical switching pulse which activates the device.

In the above referenced *Optics Communications* article, it is suggested that high voltage DC bias may be switched by cooling the device to cryogenic temperature. It has been found that cooling the device does not increase its DC hold off capability, because in nearly intrinsic material impact ionization at cryogenic temperature appears at low electrical field intensity which leads to premature avalanche breakdown. Breakdown of devices of intrinsic silicon at liquid nitrogen temperature was observed with only an 8 volt bias across short gap lengths (100 μm). Even at longer gap lengths (e.g., 2 mm) breakdown occurs at a few hundred volts bias at cryogenic temperatures.

Solid state light activated switches using gallium arsenide (GaAs) doped with chromium (Cr) has been reported to hold off a DC voltage up to 5 kilovolts without breakdown. However, output pulses of only about 600 volts amplitude limited in duration to a few hundred picoseconds are produced by light activated GaAs switching devices (see Lee, *Applied Physics Letters,* 30, 2, 84). It is a feature of this invention to provide light activated solid state switches capable of switching multi-kilovolt DC bias voltages to provide multi-kilovolt output pulses timed with precision accuracy to the occurrence of the activating light pulse and with durations into the hundred nanosecond regime without thermal instability and resulting premature breakdown of the device.

It is therefore an object of the present invention to provide improved light activated solid state switching devices which are capable of switching with picosecond accuracy.

It is another object of the present invention to provide an improved solid state switching device for generating high voltage pulses in the multi-kilovolt range with picosecond timing accuracy by switching a multi-kilovolt direct current bias voltage.

It is a further object of the present invention to provide an improved laser activated device for switching high voltages.

It is a still further object of the present invention to provide an improved high voltage pulse generator using a light activated semiconductor switch which can generate pulses having a wider range of duration than with light activated semiconductor switch generators heretofore suggested.

It is a still further object of the present invention to provide an improved light activated solid state switch for switching multi-kilovolt voltages which does not require such voltages to be applied thereto as pulses of controlled duration in order to avoid thermal instability.

Briefly described, a light activated solid state switch embodying the invention utilizes a body of semiconductor material which has deep lying charge carrier trapping centers (lying in the middle of the energy gap), as by being doped with a deep-lying impurity, and maintained at cryogenic temperatures. A direct current bias voltage in the multi-kilovolt range maybe continuously applied to the device across a gap between the electrodes on the body of semiconductor material. When a light pulse from a laser is incident on the gap, charge carriers are generated which reduce the resistivity thereof and switch the bias to a load such as a utilization device (e.g., a streak camera circuit, a Pockels cell or Kerr cell) and generates a multi-kilovolt pulse of desired duration (into the hundred nanoseconds range) in precise timed relationship with the application of the activating light.

The presently preferred semiconductor material is silicon. The silicon is preferably doped with gold as the deep-lying impurity. The concentration of gold exceeds $10^{15}$ atoms per cubic centimeter ($cm^{-3}$). The cryogenic temperature range over which the body of semiconductor material doped with the deep-lying impurity has improved high voltage hold off ranges from −40° C. to lower temperatures. Liquid nitrogen temperatures (77° K. is preferred). Other semiconductor materials which may be used are germanium (Ge) doped with such a deep-lying impurity as silver (Ag), manganese (Mn), cobalt (Co), etc. Other dopants in addition to gold which may be used to provide the deep-lying impurity in silicon are iron (Fe), zinc (Zn), etc. Gallium arsenide and indium phosphate (InP) doped with chromium (Cr) or oxygen (O) may also be used. As noted above silicon doped with gold is presently preferred. The impurity concentration determines the pulse duration since the impurity concentration governs the charge carrier recovery time which decreases with increasing concentration (see Bullis, *Solid State Electronics,* Vol. 9, Pgs. 149–151, Pergamon Press, 1966). The trapping centers can also be created by high energy particle irradiation of the semiconductor material (see M. G. Beuhler, Design Curves for Predicting Resistivity Changes in Silicon, *IEEE Proc.*, 56, 1741 (1968)). The carrier recovery time is related to the impurity or trapping center concentration by the following equation.

$$\tau=(1/\Sigma\nu N)$$

where $\tau$ is the recovery time, $\Sigma$ is the charge carrier capture cross-section, $\nu$ is the thermal velocity at the temperature of the semiconductor, and N is the impurity or trapping center concentration. The upper limit of the impurity or trapping center concentration is selected such that the recovery time, $\tau$, is not smaller than the duration of the output pulse which is desired to be generated upon switching in the device.

The operation of the device can be explained by the following theory which is presented without intending to limit the invention to any theory of operation. The mean free path of the charge carriers in the semiconductor material is increased at low temperatures. The deep-lying impurities or trapping centers scatter the charge carriers and reduce the long mean free path thus avoiding high velocities which cause impact ionization leading to premature avalanche breakdown prior to the application of the activating light pulse. The deep-lying trapping centers impurities also enhance the resistivity of the device thereby providing the advantages of low temperature operation, repetition rate and thermal enhancement, without excessively decreasing the carrier recovery time after activation by the light pulse.

The foregoing and other objects, features and advantages of the invention and the presently preferred embodiment thereof will become more apparent from a reading of the following description in connection with the accompanying drawing.

BRIEF DESCRIPTION OF THE DRAWING

The sole FIGURE of is a schematic diagram of a solid state switching device in accordance with the presently preferred embodiment of the invention.

An evacuated cryogenic chamber 10 is represented by the dash line. A cold trap 12 in the chamber is a metallic member which is cooled, as by circulating liquid nitrogen therethrough. A body 14 of semiconductor material is cooled to cryogenic temperature, in the preferred embodiment, the temperature of liquid nitrogen, by being disposed on the metallic member 12. A thin plate 16 of insulating material, preferably sapphire, 1 mm thick is disposed between the body of semiconductor material 14 and the metallic member 12. The body 14 is a bar having cross-sectional dimensions of one half of a square mm. The bar itself is approximately 5 mm long. The side of the bar which lies on the sapphire plate 16 is 1 mm wide. The bar is ½ mm thick.

Electrodes 18 and 20 on the ends of the bar leave a gap approximately 2 mm wide therebetween. The multi-kilovolt bias is provided by a direct current source 22, one side of which is grounded, as along a ground plate connected to the cold trap member 12. A transmission line 24, terminated at the source 22 by a ten kilo-ohm resistor 26, is connected to one of the electrodes 18 through a safety resistor 28. The resistance of this resistor 28 is shown as 10 megohms which is less than the resistance of the semiconductor body 14 between the electrodes 18 and 20. In the event of a failure, the safety resistor 28 limits the current flow and protects the load and the rest of the device. The transmission line 24 is a charge line, such as a coil of cable. This line determines the width of the pulse which is produced when a laser pulse indicated by the wavy line 30 is on incident on the semiconductor body 14 in the gap between the electrodes 18 and 20. A laser 32 such as a mode-locked $Nd^{+++}$:YAG laser which produces output radiation at 1.06 $\mu$m with an energy of approximately 130 $\mu$J and a full width at half maximum of about 30 picoseconds may be used to direct the light pulse onto the semiconductor body 14. The light pulse photogenerates charge carriers in the semiconductor body 14 and the causes the resistivity thereof to decrease to essentially a short circuit. The recombination time of the charge carriers is such that the pulse from the charge line 24 travels through the body of semiconductor material 14 and along a cable 34, to a load 36. The cable 34 outer conductor is connected to the ground plate. This load is indicated as a load resistor having impedance $Z_1$ which is desirably matched to the impedance at the output of the charge line 24. The load may for example be a Pockels cell, Kerr cell, framing camera, gating tube or a streak camera, which is operated in synchronism and precise timing with the light pulse from the laser 32 which activates the device. Other pulse transmission arrangements than cables as shown, such as microstrip lines, which can handle picosecond rise times may also be used.

In the preferred embodiment the semiconductor material is silicon with a doping concentration of gold as the impurity of approximately $10^{15}cm^{-3}$.

From the foregoing description it will be apparent that there has been provided an improved light activated solid state switch capable of switching high voltage in the multi-kilovolt regime to produce multi-kilovolt output pulses in precise timing with activating laser pulse. Variations and modifications of the herein described device within the scope of the invention, will undoubtedly suggest themselves to those skilled in the art. Accordingly, the foregoing description should be taken as merely illustrative and not in a limiting sense.

What is claimed is:

1. A light activated solid device for switching high voltages, including multi kilovolt level voltages, which comprises a body of semiconductor material having a pair of electrodes separated by a gap upon which light is incident when said device is activated, cryogenic means for cooling said body, and said body having a certain concentration of deep-lying charge carrier having centers therein sufficient to maintain the resistivity of said body in the presence of said high voltages and absence of said light.

2. The invention as set forth in claim 1 wherein said concentration, N, is in a range from a lower concentration of about $10^{15}cm^{-3}$ to a higher concentration such that the charge carrier recovery time period of semiconductor material of said body, $\tau$, is at least as long as a predetermined time period when said device is in closed switching condition, where $$\tau=(1/\Sigma\nu N)$$

$\Sigma$ and $\nu$ are the capture cross-section for, and thermal velocity of, the charge carriers in said semiconductor material at the temperature to which said body is cooled.

3. The invention as set forth in claim 2 wherein $\tau$ is in the range from about 30 picoseconds to 100 nanoseconds.

4. The invention as set forth in claim 3 wherein said cryogenic means provides for cooling said body to about the temperature of liquid nitrogen.

5. The invention as set forth in claim 4 wherein said body has a certain concentration of a deep lying impurity to provide said trapping centers.

6. The invention as set forth in claim 5 wherein semiconductor material is silicon, said impurity is gold, and said concentration N is approximately $10^{15}cm^{-3}$.

7. The invention as set forth in claim 4 wherein semiconductor material is selected from the group consisting of Ge, Si, GaAs, CDS and InP.

8. The invention as set forth in claim 6 wherein said semiconductor material is selected from the group consisting of Ge, Si, GaAs, and InP and said impurity is selected from (a) the group consisting of Ag, Mn, Co when said material is Ge, (b) Au, Fe, Zn when said material is Si, (c) Cr, O when said material is GaAs and (d) Cr, O when said material is InP.

9. A high voltage pulse generator which comprises a body of semiconductor material having a pair of electrodes separated by a gap, said material having a predetermined concentration of deep-lying charge carrier trapping centers, means for applying a DC voltage to one of said electrodes, means for connecting the other set of electrodes to a load, means for cooling said body to a cryogenic temperature, and means for directing a pulse of light at said gap to reduce the resistivity of said body between said electrodes and to switch said high voltage to said load to generate a high voltage pulse at said load, said concentration being sufficient to maintain the resistivity of said body in the presence of said voltage and absence of said light pulse.

10. The invention as set forth in claim 9 wherein said trapping centers are provided by a deep-lying impurity.

11. The invention as set forth in claim 10 wherein semiconductor material is Si, said impurity is Au, and said cryogenic temperature is liquid nitrogen temperature.

12. The invention as set forth in claim 9 wherein said material is selected from the group consisting of Ge, Si, GaAs, CdS and InP and said temperature is liquid nitrogen temperature.

13. The invention as set forth in claim 10 wherein said material is selected from the group consisting of Ge, Si, GaAs and InP and said impurity has a concentration of at least $10^{15}$ atoms of said impurity per cubic centimeter of said semiconductor material.

14. The invention as set forth in claim 9 wherein said concentration is, N, and is such that the recovery time, $\tau$, of charge carriers and said semiconductor material does not exceed the duration of said pulse where $$\tau=(1/\Sigma\nu N)$$

wherein $\Sigma$ is the capture cross-section and $\nu$ is the thermal velocity of said charge carriers at the liquid nitrogen temperature.

15. The invention as set forth in claim 9 wherein said means for applying said light pulse is a laser.

16. The invention as set forth in claim 9 wherein said body is a length of semiconductor material having a cross-section of about 0.5 $mm^2$, and said gap is about 2 mm long between said electrodes.

17. The invention as set forth in claim 9 wherein said cryogenic means includes a metal member, an insulating member, said body being disposed on said metal member with said insulating member therebetween.

18. The invention as set forth in claim 17 wherein said insulating member is a plate.

19. The invention as set forth in claim 18 wherein said plate is about 1 mm in thickness between said body and said metal member.

20. The invention as set forth in claim 9 wherein said means for applying said bias voltage includes a series resistor having a value of resistance lower than the resistance of said body between said electrodes in the absence of said light pulse.

21. The invention as set forth in claim 9 wherein said means for applying said DC voltage includes transmission means for controlling the duration of the pulse which is generated upon occurrence of said light pulse.

* * * * *